United States Patent [19]

Filshie

[11] Patent Number: 4,735,163

[45] Date of Patent: Apr. 5, 1988

[54] COLLAPSIBLE SAIL BOARD

[76] Inventor: Gilbert M. Filshie, 2 Pembroke Dr., Mapperley Park, Nottingham, England

[21] Appl. No.: 818,170

[22] Filed: Jan. 13, 1986

[51] Int. Cl.[4] ..... B63B 7/08

[52] U.S. Cl. ..... 114/39.2; 114/345; 114/354

[58] Field of Search ..... 441/74; 114/345, 354, 114/39.1, 39.2, 93

[56] References Cited

U.S. PATENT DOCUMENTS

| | | | |
|---|---|---|---|
| 3,577,576 | 5/1971 | Lobb | 441/74 |
| 4,149,481 | 4/1979 | Leber | 114/345 |
| 4,249,276 | 2/1981 | Snyderman | 114/345 |
| 4,530,299 | 7/1985 | Ross | 441/74 |

FOREIGN PATENT DOCUMENTS

| | | | |
|---|---|---|---|
| 2700887 | 7/1978 | Fed. Rep. of Germany | 441/74 |

OTHER PUBLICATIONS

European Patent No. 0060409, Wald, 9/82.

*Primary Examiner*—Joseph F. Peters, Jr.
*Assistant Examiner*—Edwin L. Swinehart
*Attorney, Agent, or Firm*—Salter & Michaelson

[57] ABSTRACT

A collapsible sail board is disclosed which includes an inflatable flotation member, a multisection mast, a collapsible boom, a sail, and a keel. The mast is detachably mounted on the upper side of the inflatable member so it is universally pivotable with respect thereto, and the keel is detachably mounted on the under side of the inflatable member with an attachment pocket which firmly secures the keel to the inflatable member when the latter is in an inflated condition. The sail board is lightweight and totally collapsible to a size which allows it to be contained within a suitcase so that it is easily transportable.

7 Claims, 2 Drawing Sheets

COLLAPSIBLE SAIL BOARD

FIELD OF THE INVENTION

This invention relates to a sail board. A sail board is essentially a floating board on which the user stands, intended to skim along the surface of the water, in particular on the surf, and having a sail to propel the board along.

BACKGROUND OF THE INVENTION

A disadvantage with conventional sail boards is that the board is a long rigid member which is difficult to transport requiring, for example, to be carried on the roof of a car. The present boards are also relatively heavy.

BRIEF SUMMARY OF THE INVENTION

An object of the present invention is to provide a sail board which is more readily transportable. Accordingly the sail board according to the present invention is totally collapsible allowing it to be carried in a suitcase or suitable carrying bag and may be readily assembled without the use of any tools. The board is also perferably light so that it can be carried and handled easily by juniors.

BRIEF DESCRIPTION OF THE DRAWINGS

Reference is made to the drawings, in which.

DETAILED DESCRIPTION OF THE DRAWINGS

Figure 1:
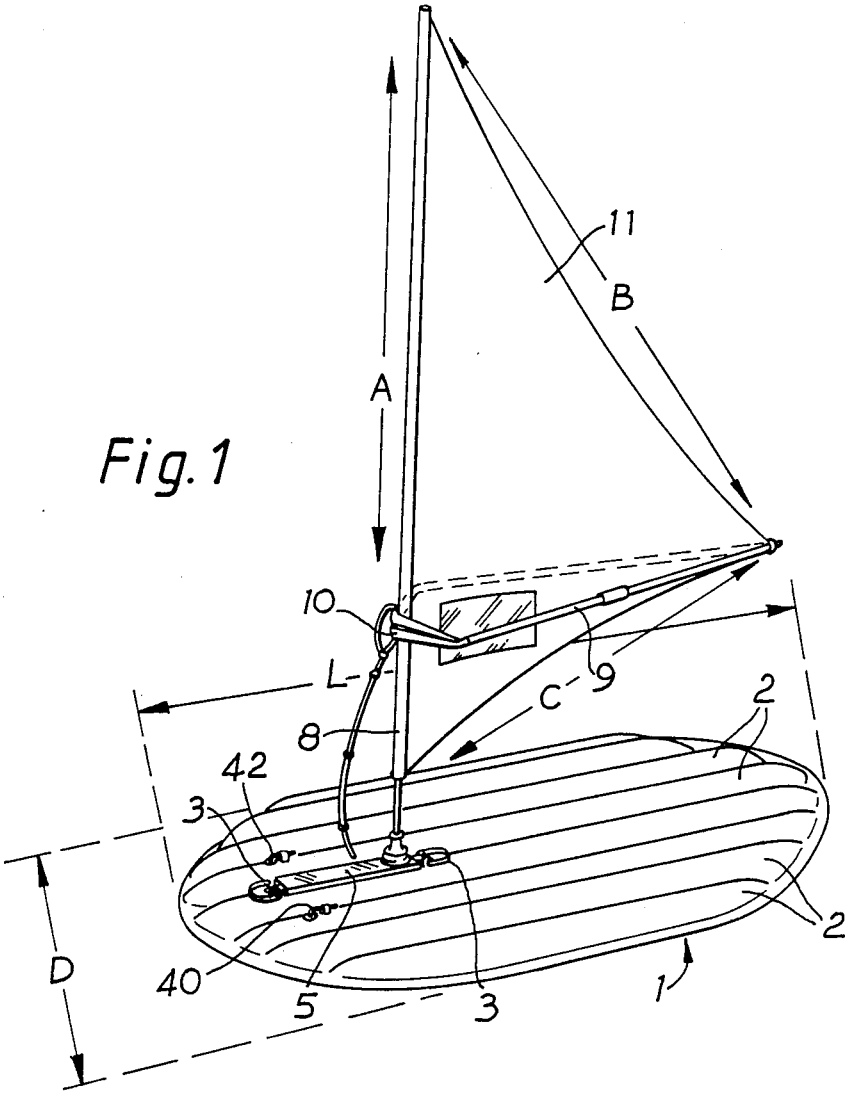
FIG. 1 is a perspective view of an example of a said board in accordance with the invention.
Figure 2:
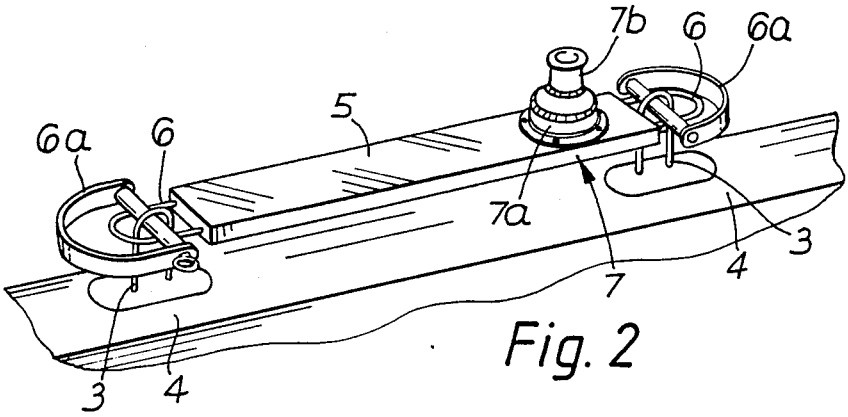
FIG. 2 is a perspective view from the side of a preferred means of mounting the mast on the flotation member.

The sail board comprises a generally flat elongated float 1 comprising a plurality of elongate air chambers 2 formed between two sheets of a plastics material, such as polyvinyl chloride, by welding. The chambers 4 may be inflated in conventional manner by an inflation tube, which may contain a valve, either individually or in separate groups, or as an interconnected series.

The upper surface of the float 1 has a spaced pair of steel loops 3 attached thereto. These may be attached by means of a small steel plate from which each loop extends, secured beneath a flap of the plastics material welded to a surface of the float. A mast securing member 5, suitably a wooden batten, has a loop 6 extending from each end thereof engageable over the respective loop 3 extending from the surface of the float 1 and secured by a cleat *6a*, or the like. A mast holder 7 is secured to the upper surface of the mast securing member 5 and comprises a resiliently deformable shoe portion *7a* from which extends upwardly an open socket *7b*. The mast holding member is suitably formed of rubber. The mast 8, which is formed of aluminium, aluminium alloy or P.V.C. tube or extrusion in sections which may be joined together in conventional manner, is held in the socket *7b* by the resilience of the material from which it is made. Preferably the mast is in three sections such that the length . f each section is short enough to be readily transportable within the trunk of the average family car.

The advantage of using a mast securing member 5 in addition to a universal joint *7a* is that less strain is imposed on the upper surface of the inflated board which even though reinforced is subject to severe strain for example when the mast is dropped as often happens when the board is sailed by beginners.

The boom 9 is also formed of aluminium P.V.C. or like tubing or extrusion joined together by an angle piece 10 which passes round the mast 8 and rests in a cut-out portion of the mast. The sail 11 is of conventional design and is secured to the mast in conventional manner for sail boards.

Figure 3:
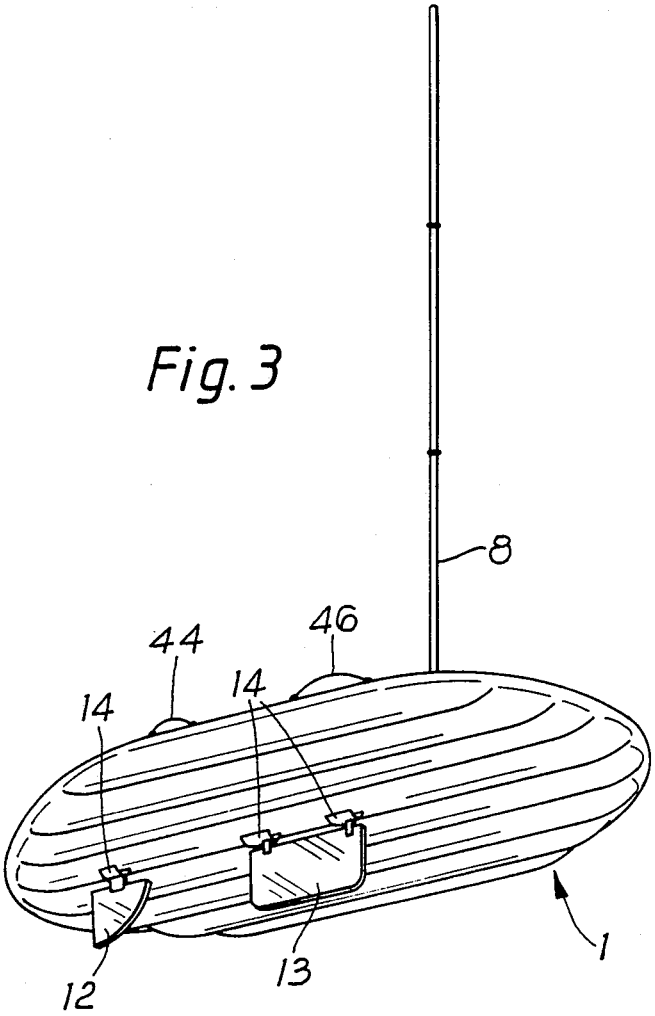
FIG. 3 is a perspective view from underneath the flotation member showing the mounting of the keel and skeg.

Referring to FIG. 3, a skeg 12 and a keel 13 are attached to the underside of the float 1 by means of pockets 14, each of which comprises a panel of flexible material attached to the underside of the float. The pockets open forwardly of the float and receive attachment elements or plates extending rearwardly from the supporting parts of the skeg or keel. The plates are a tight fit in the pockets but are removable therefrom to permit the sail board to be collapsed for transport. The pockets are made such that the attachment plates may be inserted within them when the board is partially inflated. Inflation of the board to the full pressure required to make the board stiff enough to stand on without substantially bending it effectively locks the plates into position in the pockets by the pressure exerted by the inner lining against the pocket. Thus the plates are virtually non-removable when the air chambers are inflated in full pressure. The chambers may be inflated to sufficient pressure by mouth but it is preferable to use an air pump for the majority of the inflation procedure finishing if required by a final breath to give adequate pressure.

Figure 4:
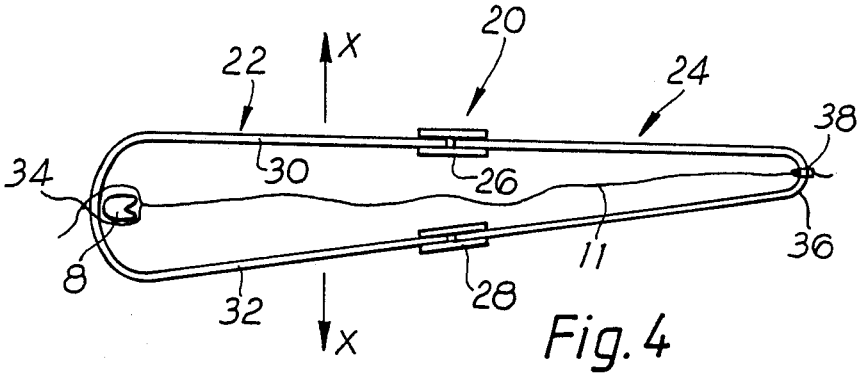
FIG. 4 shows a preferred design of boom for the sail board according to the present invention.

With reference now to FIG. 4 an alternative design for the boom is shown. The boom 20 comprises two parts 22, 24 which are joined by tubular projections 26, 28 on the arms 30, 32 of part 22. The sail 11 in use is held in position on mast 8 by a chord 34 and attached to the end 36 of arm 24 by a further chord 38. Thus the sail 22 serves to generally hold the two parts 22, 24 together. In use, the strain or pull on the boom is in the direction shown by arrows X (depending on the side being used) and this tends to force the parts 22, 24 more closely together. Thus, with a relatively simple joint the boom can be made collapsible.

By careful choice of the dimensions of boom 20 and mast 8 the individual parts can be made substantially the same length making the mast approximately 50% longer than the boom. The parts can therefore be stored in a suitable holder or small case approximately of suitcase size for easy storage and travelling.

In a particular form the width D is greater than 25% of the length L thereby giving the board great stability. Thus in this form the board is suitable particularly for training and for small children since the board is not easily overturned and release of the boom will allow the beginner or child to sit down onto the stable platform provided by the board. Since steerageway is vital the width should not exceed 50% of the length and a preferred range is between 25 and 40%. The weight of the board and sail is light being preferably less than 40 lbs and therefore the board is more easily managed both before and after launching by juniors. The board is very difficult to turn over but hand grips 44, 46 (FIG. 3) may be provided for ease in righting the board and to assist in carrying it to the water.

In a practical embodiment the board is divided into two longitudinal air compartments each with independent air inlets 40, 42 (FIG. 1). Thus, any accidental damage to one compartment will not result in the board sinking since there will be sufficient buoyancy in the other compartment to support the user.

In a practical embodiment the approximate measurements of the boards dimensions are as follows:

| | |
|---|---|
| Length L | 93" |
| Width D | 41" |
| Mast Height | 104" |
| Sail dimensions | |
| Height A | 98" |
| Side B | 90" |
| Side C | 78" |
| Length from mast base to front of board | 37" |
| Boom length | 75" |
| Weight of board sail and all fittings | 33 lbs |

I claim:

1. A collapsible sail board comprising a mast including a plurality of intermateable mast sections, a boom including a plurality of interlocking boom sections, a sail, means for attaching the sail to the mast and to the boom at the end remote from the mast whereby the sail at least partially prevents disassembly of the boom, a flotation member consisting of an inflatable mattress comprising a plurality of air chambers without reinforcing frame members, the mattress being constructed of a flexible material and being inflatable to form a platform, attachment means for mounting the mast on the upper side of the mattress so that it is universally pivotable with respect thereto, a keel comprising a center plate and an attachment element, a flexible panel secured on the underside of said mattress defining an attachment pocket for reception of said attachment element of said keel, said attachment pocket being formed such that said attachment element may be readily inserted therein when the mattress is in a deflated condition but shaped such that said attachment element is tightly gripped by the pressure exerted by one of said air chambers when the mattress is in an inflated condition thereby preventing loss of the keel.

2. A collapsible sail board as claimed in claim 1 in which the attachment means comprises a securing member flexibly attached to at least two points on the flotation member the universal joint for said mast being attached to the securing member.

3. A collapsible sail board as claimed in claim 2 in which the securing member is a rigid elongate batten flexibly secured at either end to the flotation member.

4. A collapsible sail board as claimed in claim 1 in which the flotation member is further provided with means for detachably mounting a skeg on the same side as the keel.

5. A collapsible sail board as claimed in claim 1 in which the weight of the board and sail assembly is less than 40 lbs.

6. A collapsible said board comprising a mast, a boom normally extending outwardly from said mast, a substantially triangular sail detachably connected to said boom and said mast, an inflatable flotation member made of a flexible sheet material and including a plurality of inflatable air chambers, said inflatable chambers defining opposite upper and under sides of said flotation member, means for mounting said mast on the upper side of said flotation member, a keel including a keel element and an attachment element on said keel element, a flexible panel secured on the under side of said flotation member for defining a forwardly opening attachment pocket thereon, said attachment pocket being constructed so that said attachment element is receivable therein when said inflatable chamber on which it is mounted is in a deflated condition and so that said attachment element is firmly embraced by said attachment pocket and the adjacent portion of said inflatable chamber on which said pocket is mounted when the latter is in an inflated condition to retain said attachment element in said attachment pocket.

7. In the collapsible sail board of claim 6, said inflatable air chambers defining the sole structural elements of said flotation member and being constructed substantially entirely from said sheet material.

* * * * *